US012287170B2

(12) United States Patent
Sullivan

(10) Patent No.: US 12,287,170 B2
(45) Date of Patent: Apr. 29, 2025

(54) PROJECTILE LAUNCHER MAINTAINED BREECH PRESSURE FEATURE

(71) Applicant: Brian Sullivan, Alta Loma, CA (US)

(72) Inventor: Brian Sullivan, Alta Loma, CA (US)

( * ) Notice: Subject to any disclaimer, the term of this patent is extended or adjusted under 35 U.S.C. 154(b) by 27 days.

(21) Appl. No.: 18/218,233

(22) Filed: Jul. 5, 2023

(65) Prior Publication Data

US 2025/0012541 A1 Jan. 9, 2025

(51) Int. Cl.
*F41B 11/73* (2013.01)
*F41A 21/00* (2006.01)

(52) U.S. Cl.
CPC ..... *F41B 11/73* (2013.01); *F41A 21/00* (2013.01)

(58) Field of Classification Search
CPC ..... F42B 11/73; F41A 21/00
See application file for complete search history.

(56) References Cited

U.S. PATENT DOCUMENTS 5,280,778 A * 1/1994 Kotsiopoulos ..... F41B 11/723 124/31
5,327,878 A * 7/1994 Wittbrot ..... F41B 11/52 124/56
5,404,863 A 4/1995 Poor
5,522,374 A 6/1996 Clayton
5,771,875 A 6/1998 Sullivan
5,987,797 A 11/1999 Dustin
6,273,080 B1 * 8/2001 Sullivan, Jr. ..... F41B 11/00 124/83
6,513,274 B1 2/2003 Vastag
6,637,420 B2 10/2003 Maritz
6,766,795 B1 7/2004 Sullivan
7,302,881 B1 12/2007 Tertin
7,562,478 B1 7/2009 Vastag
7,735,409 B1 6/2010 Tertin
7,926,408 B1 4/2011 Kley
8,761,702 B2 6/2014 Haub et al.
9,631,891 B2 * 4/2017 Sullivan ..... F41B 11/62
11,346,634 B2 * 5/2022 Sullivan ..... F41B 11/721
2004/0089280 A1 * 5/2004 Kunimoto ..... F41B 11/723 124/76
2006/0180134 A1 8/2006 Illuzzi
2007/0017497 A1 1/2007 Masse
2007/0089723 A1 4/2007 Mott
2010/0059032 A1 3/2010 Zadra
2010/0282229 A1 11/2010 Tran
(Continued)

*Primary Examiner* — Joshua E Freeman
(74) *Attorney, Agent, or Firm* — Kirk A. Buhler; Buhler & Associates Patenting

(57) ABSTRACT

Improvements in a projectile launcher with a two-part bolt is disclosed. The two-part bolt has a forward bolt that moves and locates the projectile from the magazine to the breach. The ball is maintained in the breach until pressurized air pushes the projective out of the launcher. A ball holder is biased by a spring and when the bolt is moved, the bolt will lift the ball holder and blocks loading of a second projectile. An adjustable barrel detent alters pressure on top of the projectile to create backspin. The two bolt parts forms a piston to drive the projectile forward. A spring between the forward bolt and the rear bolt to maintains an extended biased location between the two bolt components. Travel between the two bolt elements if maintained by a pin that is retained in the rear bolt with a pin keeper spring.

20 Claims, 7 Drawing Sheets

(56) References Cited

U.S. PATENT DOCUMENTS

| | | | | |
|---|---|---|---|---|
| 2015/0007804 | A1* | 1/2015 | Tippmann, Jr. | F41B 11/70 124/73 |
| 2016/0047621 | A1* | 2/2016 | Sullivan | F41B 11/55 124/73 |
| 2016/0076850 | A1* | 3/2016 | Sullivan | F41A 19/12 124/63 |
| 2019/0226795 | A1* | 7/2019 | Sullivan | F41B 11/55 |
| 2022/0099404 | A1* | 3/2022 | Sullivan | F41B 11/721 |

* cited by examiner

PROJECTILE LAUNCHER MAINTAINED BREECH PRESSURE FEATURE

CROSS REFERENCE TO RELATED APPLICATION

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

This invention relates to improvements in pneumatic launchers and, more particularly, to novel systems and methods for a projectile launcher that maintains breech pressure.

Description of Related Art Including Information Disclosed Under 37 CFR 1.97 and 1.98

Conventional firearms have a firing mechanism to fire a projectile and a barrel to direct the projectile in a desired direction. Guns are made for numerous purposes and include many designs, for example, rifles, shot guns, and handguns. A broad array of different mechanisms for firing a projectile have been employed for various types of guns. For example, one type of gun is dependent on having a propellant combined with the projectile. In this type of gun, the firing mechanism detonates the propellant contained in the projectile, which launches the projectile along the barrel. This type includes shot guns, which fire cartridges comprised of shot packaged with explosive material, and conventional rifles, machine guns, and handguns, which shoot bullets comprised of a unitary slug packaged with explosive material in a casing.

Another method of firing a projectile uses a propulsion source separate from the projectile, such as compressed gas, including air, carbon dioxide, nitrogen, and others. Examples of such guns include, air riffles, BB guns, and paintball guns or "markers." These guns either include a pump for compressing ambient air or are adapted to receive compressed air from a source, such as a compressed gas cartridge or gas cylinder. Conventional paintball guns rely on such cartridges or gas cylinders for supplying compressed gas, including air, nitrogen, and carbon dioxide.

Nearly all similar "blowback" systems (simultaneously firing and re-cocking) begin an erratic and non-resetting motion to take place the moment that the system does not have enough supply gas pressure to completely "reset" the unit. "ALL" of these systems. This non-resetting behavior occurs with most guns that are in the market around 650 psi at best (normal operating pressures and tanks for these systems is approximately 800 psi).

Another problem with pneumatic launcher is because the masses of the bolt or hammer is so large as opposed to the mass of the projectile and the surface area of the projectile. In the blowback system, in pressures below 650-800 psi the pressure is too low for the hammer to re-cock itself by sufficiently returning to engage on the sear. This problem is present in existing blowbacks launchers. Launchers that can operate at lower pressures have bad air use efficiencies.

What is needed is a projectile launcher that maintains breech pressure. The projectile launcher-maintained breech pressure feature disclosure found in this document provides a solution.

BRIEF SUMMARY OF THE INVENTION

It is an object of the projectile launcher-maintained breach pressure feature to use a two-part bolt. The two-part bolt has a forward bolt that moves and locates the projectile from the magazine to the breach. The ball is maintained in the breach until pressurized air pushes the projective out of the barrel of the launcher.

It is another object of the projectile launcher-maintained breach pressure feature to utilize a ball holder that maintains a position of the projectile until it is moved into the breach for firing. The ball holder is biased by a spring and when the bolt is moved, the bolt will lift the ball holder and blocks loading of a second projectile. The ball holder is located above the loading queue from the magazine where projectiles are fed into the launcher. The projectile is preferably a solid BB, but the launching system could be altered to accommodate a paintball or other pneumatically launched projectile.

It is another object of the projectile launcher-maintained breach pressure for the launcher to have an adjustable backspin "hoppa system" barrel detent to alter the pressure on the projectile when it is launched to create backspin on the projectile to maintain a straight flight to overcome some (or all) of the forces of gravity for at least some of the flight time of the projectile.

It is another object of the projectile launcher-maintained breach pressure feature for the two-part bolt to create a piston interface between the two bolt parts. The piston drives the projectile forward and to prevent a "spongy shot" where all the air is not directed to the ball to go forward, but by the surface area acting on the projectile that might cause some componentry to go backwards.

It is still another object of the projectile launcher-maintained breach pressure feature for the two-part bolt to incorporate a spring between the forward bolt and the rear bolt to maintain an extended biased location between the two bolt components. Travel between the two bolt elements if maintained by a pin that is retained in the rear bolt with a pin keeper spring. The travel of the forward bolt is restrained by the pin in a pin slot. The forward bolt is pushed into the rear bolt when a shoulder in the forward bolt contacts the circumference of the inside diameter of the bolt sleeve.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

DETAILED DESCRIPTION OF THE INVENTION

Figure 1:
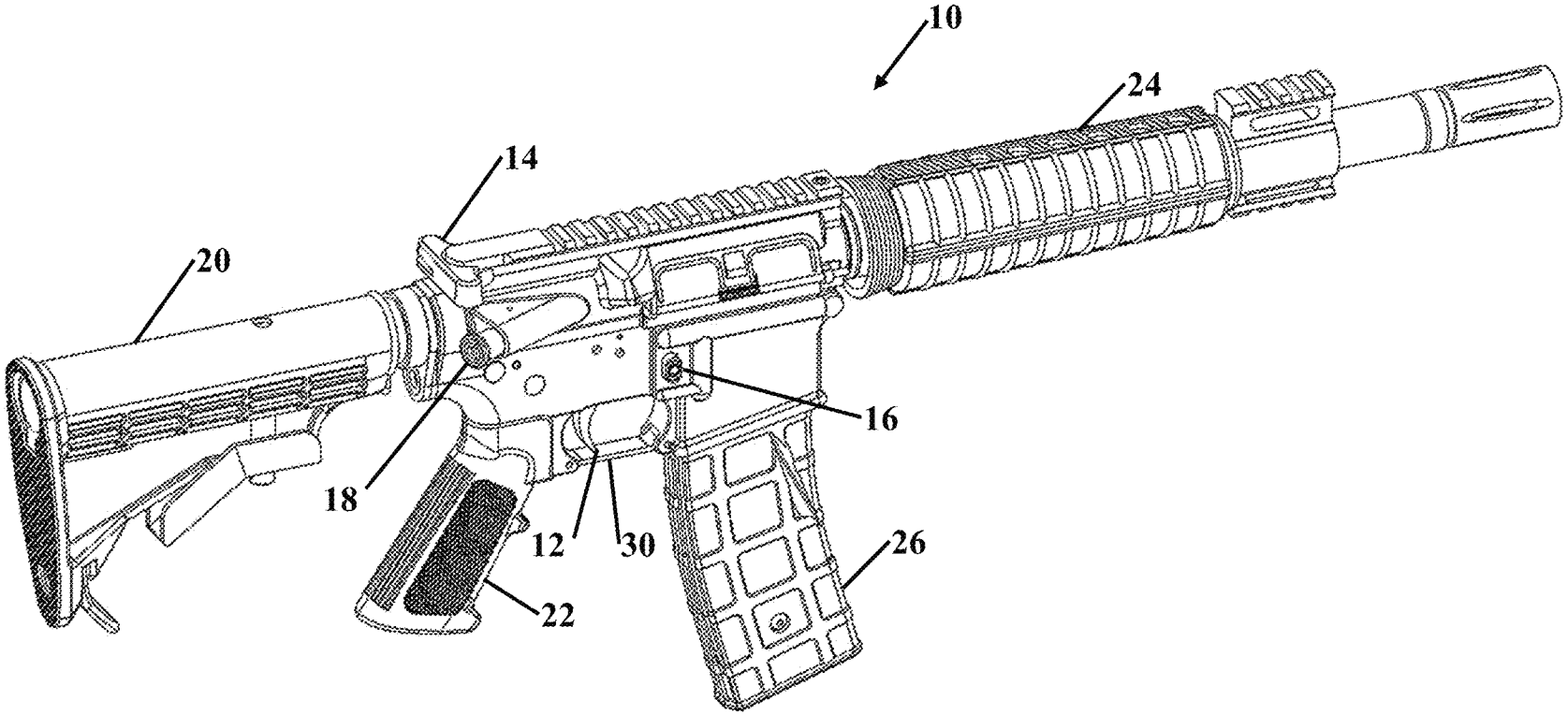
FIG. 1 shows a perspective view of the exterior of a launcher.

It will be readily understood that the components of the present invention, as generally described and illustrated in the drawings herein, could be arranged and designed in a wide variety of different configurations. Thus, the following more detailed description of the embodiments of the system and method of the present invention, as represented in the drawings, is not intended to limit the scope of the invention but is merely representative of various embodiments of the invention. The illustrated embodiments of the invention will be best understood by reference to the drawings, wherein like parts are designated by like numerals throughout.

| Item Numbers and Description | |
|---|---|
| 10 launcher | 11 novel launcher |
| 12 trigger | 14 charger handle |
| 15 projectile(s) | 16 magazine release |
| 18 forward assist | 20 butt stock |
| 22 grip | 24 fore grip |
| 26 magazine | 30 trigger guard |
| 34 upper receiver | 36 lower receive |
| 38 lower receiver | 40 valve assembly |
| 41 recess | 42 trigger assembly |
| 43 piston area | 44 stock mount |
| 45 spring recess | 46 barrel |
| 48 barrel detent | 49 adjustable |
| 50 bolt assembly | 51 bolt assembly |
| 52 pins | 53 shoulder |
| 54 sear | 55 inside diameter |
| 56 bolt catch | 57 catch |
| 58 pivots | 59 pivot |
| 60 biasing member | 61 cushion |
| 62 cushion | 63 stops |
| 64 sliding bolt | 65 rear bolt |
| 66 biasing member | 67 forward bolt |
| 68 valve | 70 conduits |
| 72 space | 73 spring |
| 74 ramp | 75 pin |
| 76 wear element | 77 projectile locator |
| 78 manifold | 79 striker |
| 80 first aperture | 81 second aperture |
| 82 aperture | 83 rear bolt |
| 84 particular space | 85 pin keeper spring |
| 86 bolt sleeve | 88 separator |
| 89 pin slot | 90 fastener(s) |
| 91 backspin | 92 end cap |
| 93 forward | 94 buffer |
| 95 down | 96 forward portion |
| 97 firing air path | 98 rearward position |

-continued

| Item Numbers and Description | |
|---|---|
| 99 back | 100 an extension |
| 102 slot | 104 bolt sleeve aperture |
| 106 bolt aperture | 108 aperture |
| 110 port | 112 projectile retainer |
| 114 projectile in breach | |

Referring to FIG. 1 a launcher 10 is shown in accordance with the one contemplated embodiment that may support pneumatic actuation of one or more components thereof. For example, a launcher 10 may support pneumatic actuation or manipulation of an action thereof. Alternatively, or in addition thereto, pneumatic forces may be responsible for propelling a projecting out of a launcher 10.

In selected embodiments, a launcher 10 may have an exterior look and feel that mimics, substantially matches, or matches the look and feel of a particular firearm (e.g., rifle, pistol, or the like). For example, as shown in FIG. 1, a launcher 10 may match or substantially match the exterior dimensions, look and feel, or the like of an AR-15 type rifle. A launcher 10 may also have external controls that match or substantially match the exterior controls of an AR-15 type rifle. Accordingly, a launcher 10 may provide an effective simulation or training platform.

For example, a launcher 10 may include a trigger 12, charging handle 14, magazine release 16, forward assist 18, butt stock 20 (e.g., adjustable butt stock), grip 22, fore grip 24, magazine 26, trigger guard 30, or the like or a combination or sub-combination thereof that collectively or individually match or substantially match the operations, sizes, shapes, and/or relative positions of comparable components on an AR-15 type rifle. In certain embodiments, all such components may be functional. In other embodiments, certain components (e.g., a forward assist 18 and/or bolt release) may be provided merely to maintain aesthetic realism but may otherwise be non-functional.

In certain embodiments, various components of a launcher 10 in accordance with the present invention may be actual AR-15 parts. For example, in selected embodiments, a butt stock 20, grip 22, fore grip 24, trigger guard 30, or the like or a combination or sub-combination thereof may be actual AR-15 parts (e.g., "milspec" parts, aftermarket parts, or the like). Accordingly, a user may customize his or her launcher 10 in the same manner and/or with the same parts as he or she would with an actual AR-15 type rifle.

Figure 2:
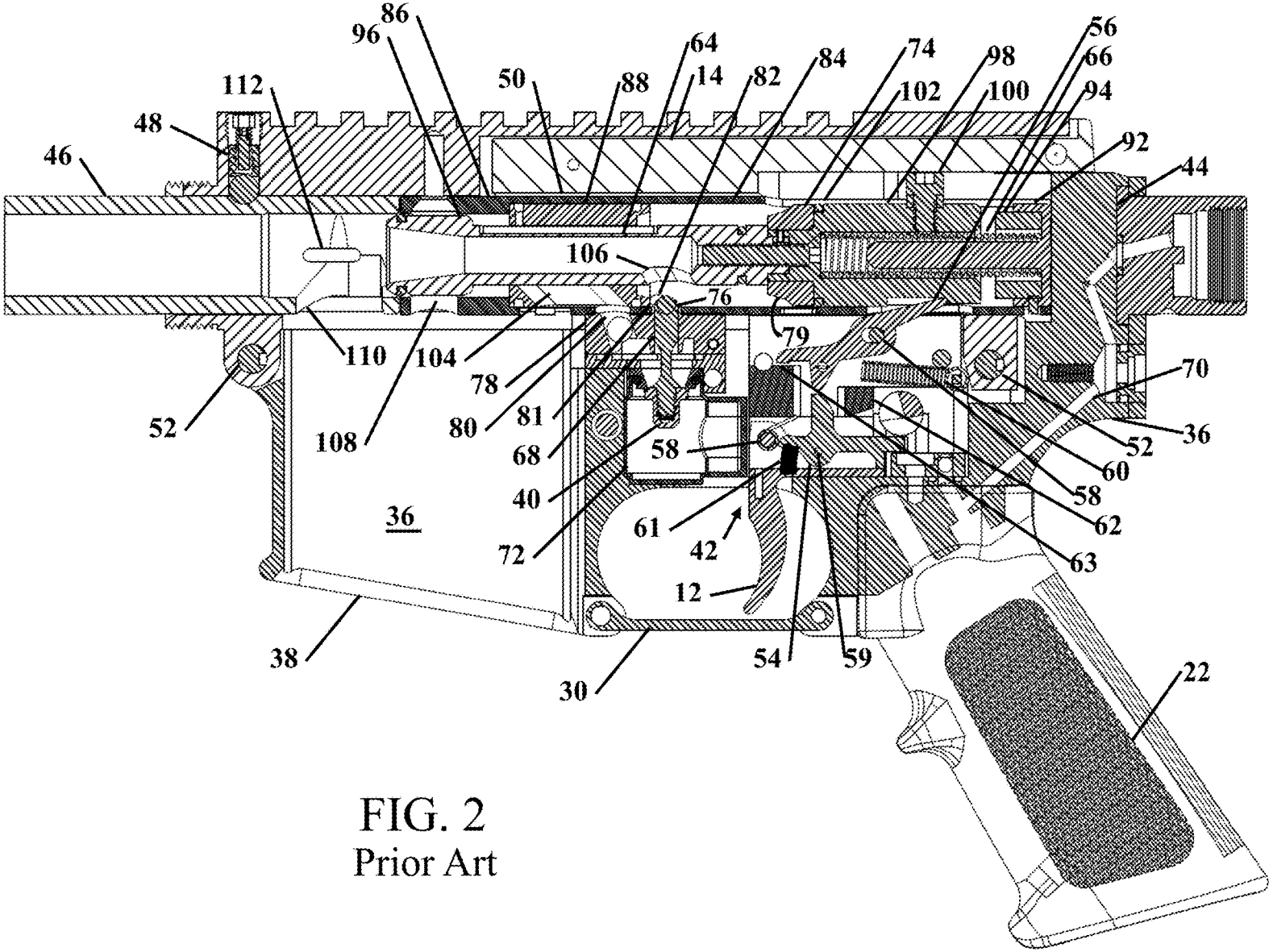
FIG. 2 Prior Art
FIG. 2 shows a sectional view of a prior art launcher with the internal components.

Referring to FIG. 2, in selected embodiments, a launcher 10 may comprise an upper receiver (Not shown) and a lower receiver 38. For example, in certain embodiments, a magazine well, valve assembly 40, trigger assembly 42, grip 22, and stock mount 44 may correspond to a lower receiver 38, while a barrel 46, barrel detent 48, bolt assembly 50, and charging handle 14 may correspond to an upper receiver.

An upper receiver may be separable from a lower receiver 36. For example, one or more pins 52 may secure an upper receiver 34 to a lower receiver 36. Removal of one or more such pins 52 may grant access to a bolt assembly 50, valve assembly 40, trigger assembly 42, or the like. In selected embodiments, the various components of an upper receiver may be secured. Similarly, the various components of a lower receiver 36 may be secured. In selected embodiments, a trigger assembly 42 may include a trigger 12, sear 54, bolt catch 56, one or more pivots 58, 59, one or more biasing members 60, one or more cushions 61, 62, and one or more stops 63. Pulling the trigger 12 may cause a sear 54 to pivot until it contacts a bolt catch 56. With sufficient pressure, a sear 54 may urge a bolt catch 56 out of engagement with a bolt 64 of a bolt assembly 50. Once a bolt 64 is free of a bolt catch 56, the bolt 64 may move forward as biased by a biasing member 66 acting on the bolt 64. In selected embodiments, a bolt 64 may travel forward to actuate a valve 68 of a valve assembly 40.

Compressed gas (e.g., compressed air, compress carbon dioxide, or the like) may be conducted by one or more conduits 70 to an upstream side of a valve 68 in a suitable manner. In selected embodiments, a launcher 10 may provide or include a platform supporting multiple entry points for compressed gas. For example, in certain embodiments, a lower receiver 36 may include conduits 70 for receiving compressed gas from a butt stock (e.g., via a container or conduit located in the place of a "buffer tube") or a grip 22 (e.g., via a container or conduit located within a grip 22) or a combination thereof. In any given embodiment, entry points that are not to being used may be sealed with an appropriate plug. A manufacturer may have selected from among various arrangements or configurations with respect to the entry point of compressed gas.

Regardless of the entry point used, compressed gas may be passed by one or more conduits 70 from a reservoir, source, or container of some sort (e.g., 12 or 16-gram canister of carbon dioxide or the like) to an upstream side of a valve assembly 40 (e.g., past a trigger assembly 42 to a space 72 or cavity 72 on an upstream side of the valve assembly 40).

A valve 68 of a valve assembly 40 may be biased toward a closed position by the pressure of gas on the up-stream side of the valve 68, by a biasing member (e.g., by an unknown biasing member within the space 72 or cavity 72), or by some combination thereof. However, after a trigger 12 is pulled and a bolt 64 moves forward, a ramp 74 forming part of the bolt 64 where the striker 79 makes contact the top portion of the valve 68 (e.g., a wear element 76 of a valve 68) and force the valve 68 open.

With a valve 68 open, compressed gas may be able to pass from an upstream side of the valve 68 and through one or conduits of a manifold 78 forming a down-stream part of a valve assembly 40. Accordingly, in selected embodiments, a manifold 78 may control how compressed gas is distributed within a launcher 10. For example, in selected embodiments, a manifold 78 may include a first aperture 80 directing a first stream of compressed gas to launch a chambered projectile (not shown) and a second aperture 81 directing a second stream of compressed gas to an aperture 82 feeding a particular space 84 within a bolt assembly 50. Compressed gas within this space 84 may slow the forward motion of a bolt 64, stop the forward motion of the bolt 64, produce a rearward motion of both 64, return a bolt 64 to a cocked position (e.g., where a bolt catch 56 has once again engaged a bolt 64), or some combination thereof.

In selected embodiments, a bolt assembly 50 may include a bolt sleeve 86, separator 88, end cap 92, buffer 94, bolt 64, or the like or a combination or sub-combination thereof. A bolt sleeve 86 may provide an interface between a bolt 64 and an upper receiver 34. In certain embodiments, a bolt sleeve 86 may include apertures permitting a valve 68, compressed gas, bolt catch 56, to enter a bolt assembly 50. A bolt sleeve 86 may have an interior surface against which various other components of a bolt assembly 50 may seal. In certain embodiments, a bolt sleeve 86 may be selectively removable. Accordingly, one or more fasteners 90 (e.g., threaded fasteners) may secure a bolt sleeve 86.

In selected embodiments, the separator 88 may separate compressed gas for launching a projectile from compressed gas for returning the bolt 64 to a cocked position. In selected embodiments, the bolt 64 may pass through a central aperture of a separator 88. Additionally, the separator 88 may include an aperture 104 aligned to receive compressed gas from a first aperture 80 of a manifold 78. Accordingly, once a valve 68 is actuated, this aperture 104 of the separator 88 may align with an aperture 106 in a forward portion 96 of the bolt 64, thereby enabling compressed gas to pass forward through a central (e.g., axial) aperture 108 in the forward portion 96 and propel a projectile out the barrel 46.

The bolt 64 may include a forward portion 96, rearward portion 98, ramp 74, extension 100, or the like or a combination or sub-combination thereof. A rearward portion 98 may interface with the biasing member 66 urging the bolt 64 forward. For example, in selected embodiments, a rearward portion 98 may include an aperture for receiving such the biasing member 66. As a bolt moves forward, the forward portion 96 may push a projectile off the top of the magazine 26 and into the chamber location of the barrel 46. In a forward position, a forward portion 96 may also form a bridge for conducting compressed gas past one or more openings (e.g., a port 110 in a barrel through which projectiles pass) that would otherwise permit compressed gas to escape.

In selected embodiments, an extension 100 of the bolt 64 may extend through a corresponding slot 102 in the bolt sleeve 86. According, as the charging handle 14 is pulled rearward, it may engage an extension 100 and pull the bolt 64 rearward. This rearward motion may continue until the bolt catch 56 engages an appropriate edge, lip, or surface of the bolt 64 (e.g., of the rearward portion 98). In this manner, certain embodiments of the launcher 10 may be manually cocked.

Figure 3:
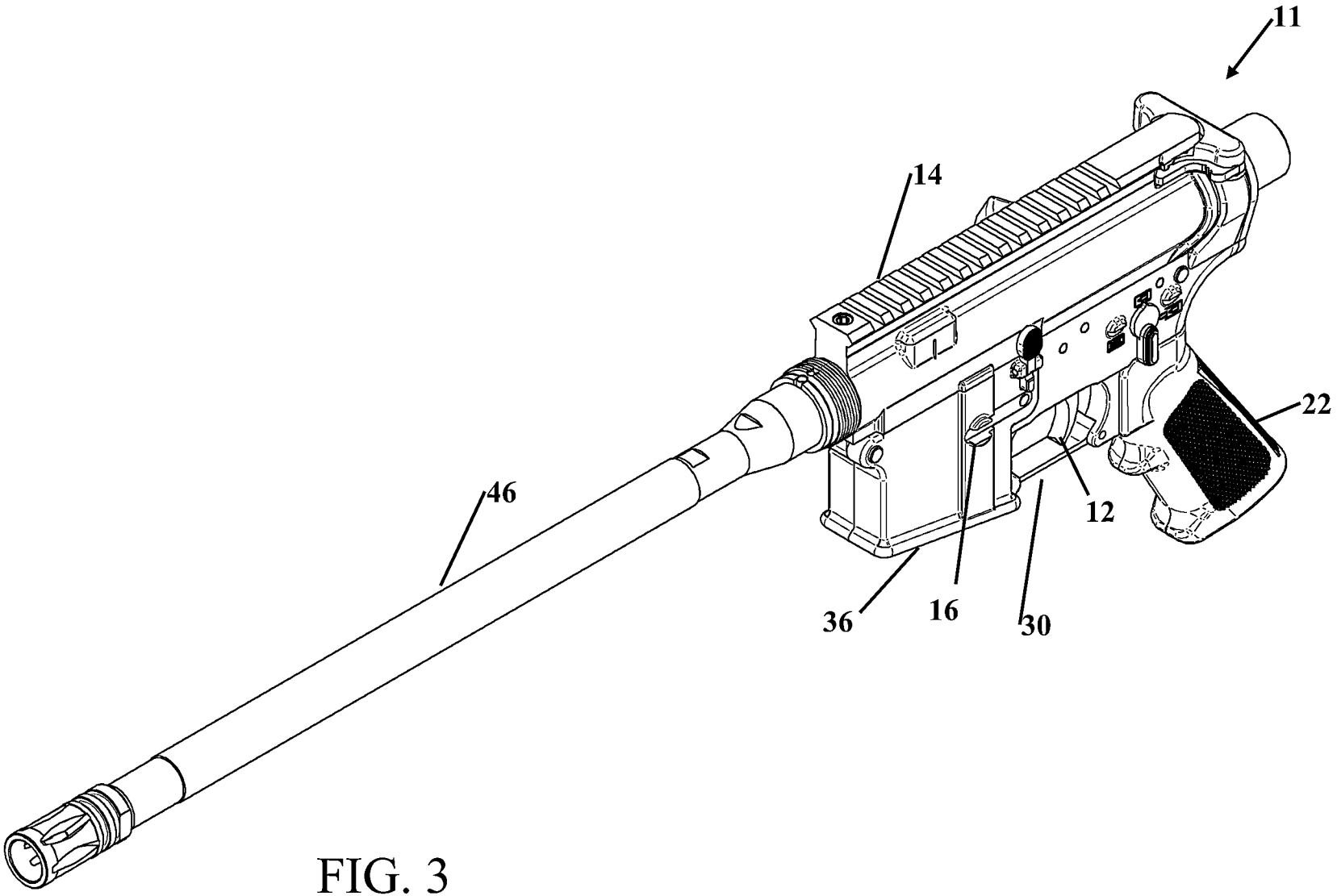
FIG. 3 shows the external assembly of the launcher without cosmetic housings.

FIG. 3 shows the external assembly of the launcher 11 without cosmetic housings. Specifically, the butt stock, fore grip and magazine have been removed. The butt stock and fore grip are selected to provide an appearance of a specific firearm like an AK47, AR15 or other popular firearm. The internal structure remains essentially the same while the cosmetic outer elements can be interchanged. In this "stripped" version the launcher 11 has a barrel 46 connected to the firing body with a charger handle 14, lower receiver 36, magazine release 16, trigger guard 30, trigger 12 and grip 22. With this basic understanding, other figures show a cross-section of the launcher 11, the novel components and their operation.

Figure 4:
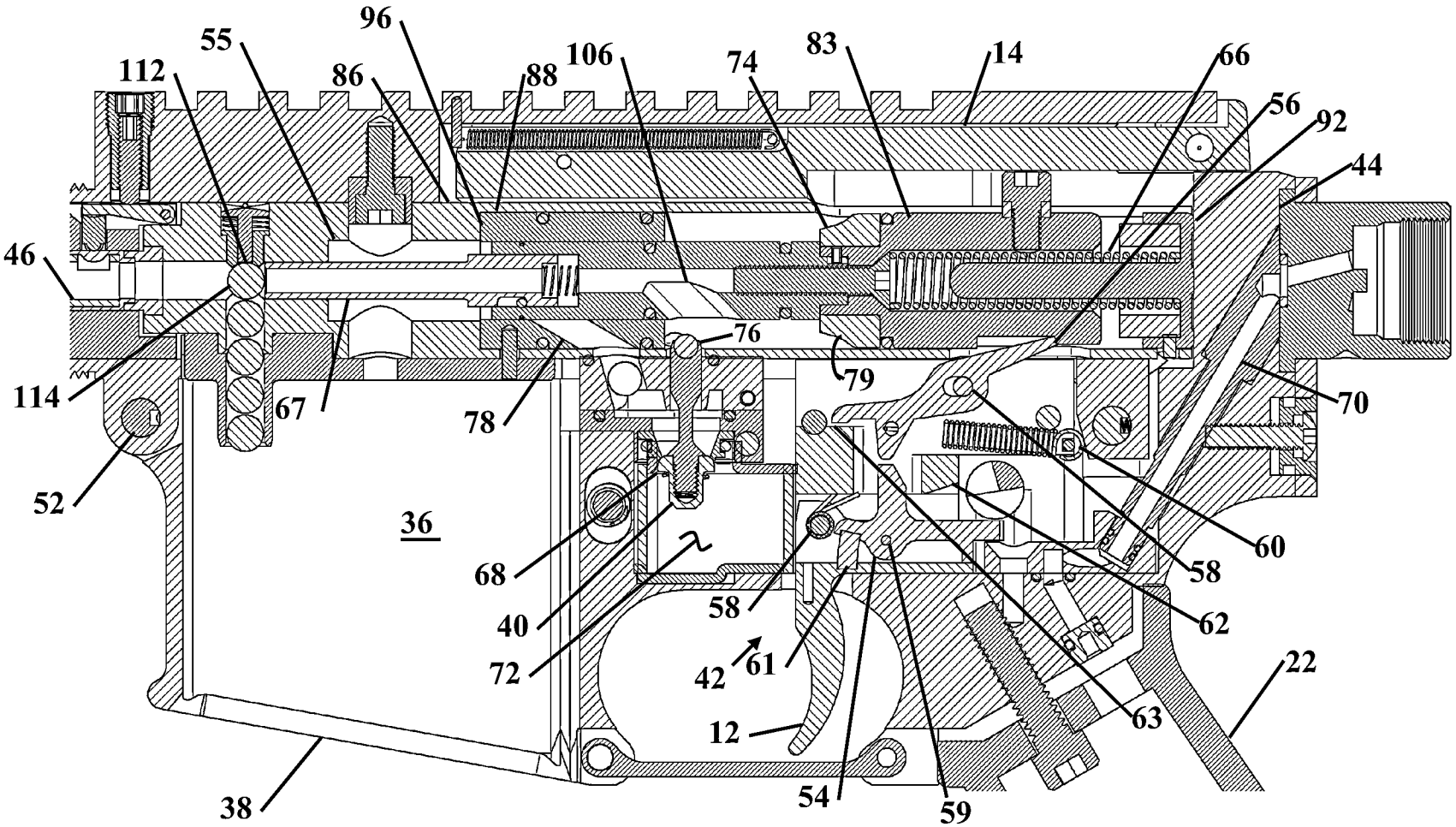
FIG. 4 show a sectional view of a novel launcher.

FIG. 4 show a sectional view of a novel launcher 11 that comprise a magazine well, valve assembly 40, trigger assembly 42, grip 22, and stock mount 44 may correspond to a lower receiver 38, while a barrel 46, barrel detent 48, bolt assembly having a forward bolt 67 and rear bolt 83, charging handle 14 may correspond to an upper receiver.

An upper receiver may be separable from a lower receiver 36. For example, one or more pins 52 may secure an upper receiver 34 to a lower receiver 36. The trigger assembly 42 may include a trigger 12, sear 54, bolt catch 56, one or more pivots 58, 59, one or more biasing members 60, one or more cushions 61, 62, and one or more stops 63. Pulling the trigger 12 may cause a sear 54 to pivot until it contacts a bolt catch 56. With sufficient pressure, a sear 54 may urge a bolt catch 56 out of engagement with the rear bolt 83. Once the rear bolt 83 is free of a bolt catch 56, the bolt assembly may move forward as biased by a biasing member 66 acting on the rear bolt 83.

Compressed gas (e.g., compressed air, compress carbon dioxide, or the like) may be conducted by one or more conduits 70 to an upstream side of a valve 68 in a suitable manner past a trigger assembly 42 to a space 72 or cavity 72 on an upstream side of the valve assembly 40).

A valve 68 of a valve assembly 40 may be biased toward a closed position by the pressure of gas on the up-stream side of the valve 68, by a biasing member (e.g., by an unknown biasing member within the cavity space 72, or by some combination thereof. However, after a trigger 12 is pulled and the rear bolt 83 moves forward, a ramp 74 forming part of the rear bolt 83 where the striker 79 makes contact the top portion of the valve 68 (e.g., a wear element 76 of a valve 68) and force the valve 68 open.

With a valve 68 open, compressed gas may be able to pass from an upstream side of the valve 68 and through one or conduits of a manifold 78 forming a down-stream part of a valve assembly 40. Accordingly, in selected embodiments, a manifold 78 may control how compressed gas is distributed within a launcher 11. A bolt sleeve 86 provides an interface between a bolt and an upper receiver.

In selected embodiments, the separator 88 may separate compressed gas for launching a projectile from compressed gas for returning the rear bolt 83 to a cocked position. The separator 88 may include an aperture 104 aligned to receive compressed gas from a first aperture 80 of a manifold 78. Accordingly, once a valve 68 is actuated, this aperture 106 of the separator 88 may align with an aperture 106 in a forward portion 96, thereby enabling compressed gas to pass forward through a central (e.g., axial) aperture 106 in the forward portion 96 and propel a projectile out the barrel 46.

The end cap 92 may fit within a bolt sleeve 86 and provide an interface between the rear bolt 83 and a stock mount 44 of a lower receiver 36. The buffer 94 may cushions an impact between a returning rear bolt 83 and the end cap 92. The bolt assembly includes a forward bolt 67

The barrel 46 includes a projectile retainer 112. The projectile retainer 112 may hold a projectile 114 in a desired location, ready to be pushed forward into the chamber of the barrel 46. In certain embodiments, the projectile retainer 112 may deflect, retract (in the embodiment shown) or pivot out of the way as the forward bolt 67 chambers a projectile.

When the motion of the bolt going forward, as a ball is loaded the striker goes forward and contacts the valve. The first thing the air wants to do is to immediately blow it back because the gasses are simultaneously going out to the ball and also back to the re-cock chamber. In the blow-back systems the air that is expelled is expelled against a large diameter that translates into a very large surface area. This creates and additional piston that wants to be blown-back. Air is trying to blow the projectile out, while the pressure that is building to fire the projectile out is also trying to urge the chamber rearward against the valve.

Figure 5A:
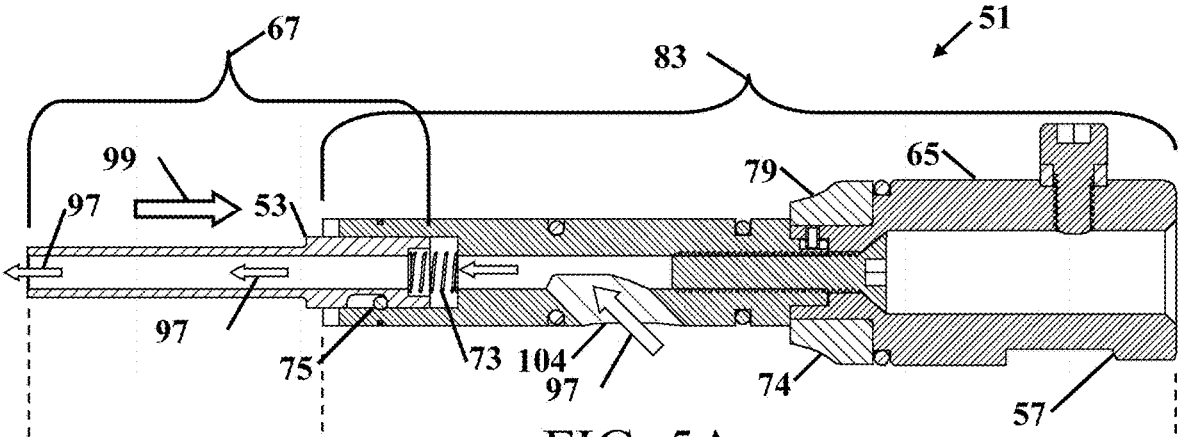
FIG. 5A shows a detail sectional view of the interface of the two parts of the two-part bolt with the two-part bolt extended.
Figure 5B:
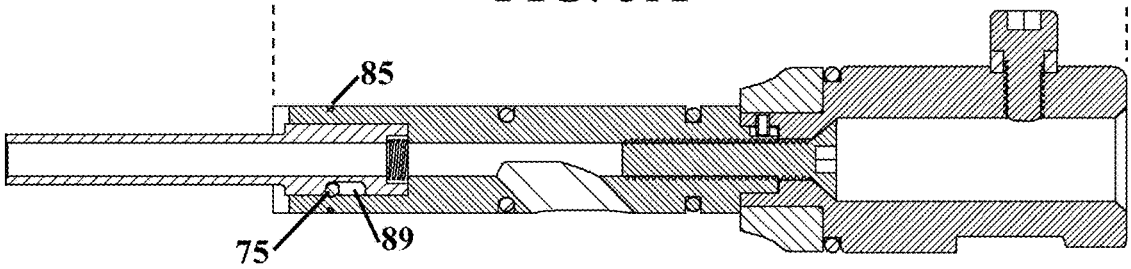
FIG. 5B shows a detail sectional view of the interface of the two parts of the two-part bolt with the two-part bolt compressed.

FIG. 5A shows a detail sectional view of the bolt assembly 51 interface of the two parts of the two-part bolt 67/83 with the two-part bolt 67/83 extended and FIG. 5B shows a detail sectional view of the bolt assembly 51 interface of the two parts of the two-part bolt 67/83 with the two-part bolt 67/83 compressed. The two-part bolt consists of the rear bolt 83 and the forward bolt 67. The forward bolt 67 is retained in the rear bolt 83 with a pin 75 that is retained in the rear bolt 83 with a pin keeper spring 85. The travel of the forward bolt 67 is restrained by the pin 75 in a pin slot 89. The forward bolt 67 is biased in an extended position by a compression spring 73. The forward bolt 89, the spring 73 and the front portion of the rear bolt are hollow to allow for a firing air path 97 from the bolt sleeve aperture 104 to out the front of the forward bolt 67 in the rear bolt 65.

When the bolt catch is released from the catch 57, the bolt assembly moves forward until the ramp 74 of the striker 79 contacts the valve 76 (shown in previous figures). When the bolt assembly 51 moves forward the air path of the bolt sleeve aperture 104 aligns with the air supply. As the bolt assembly 51 moves forward, a compression of the bolt assembly 51 occurs as the two-part bolt 67/83 is pushed together when the shoulder 53 of the forward bolt 67 makes contact with the circumference of the inside diameter 55 of the bolt sleeve 86 (shown in FIG. 4) to move the forward bolt 67 back 99 into the rear bolt 83. As the forward bolt 67 moves forward it will move the projectile from the projectile retainer 112 towards the breach (shown in the next figure). The projectile is then placed right behind the barrel detent 48 that is located before the barrel. The barrel detent 48 is an elastomeric controller "hoppa system". The projectile is centered and can't go backward because the forward bolt 67 and can't move forward because it is located by the projectile locator 77. The projectile locator 77 is biased in a lowered position by a spring and forward movement of the forward bolt 67 will also lift the projectile locator 77 as shown and described in other figures herein.

Figure 6:
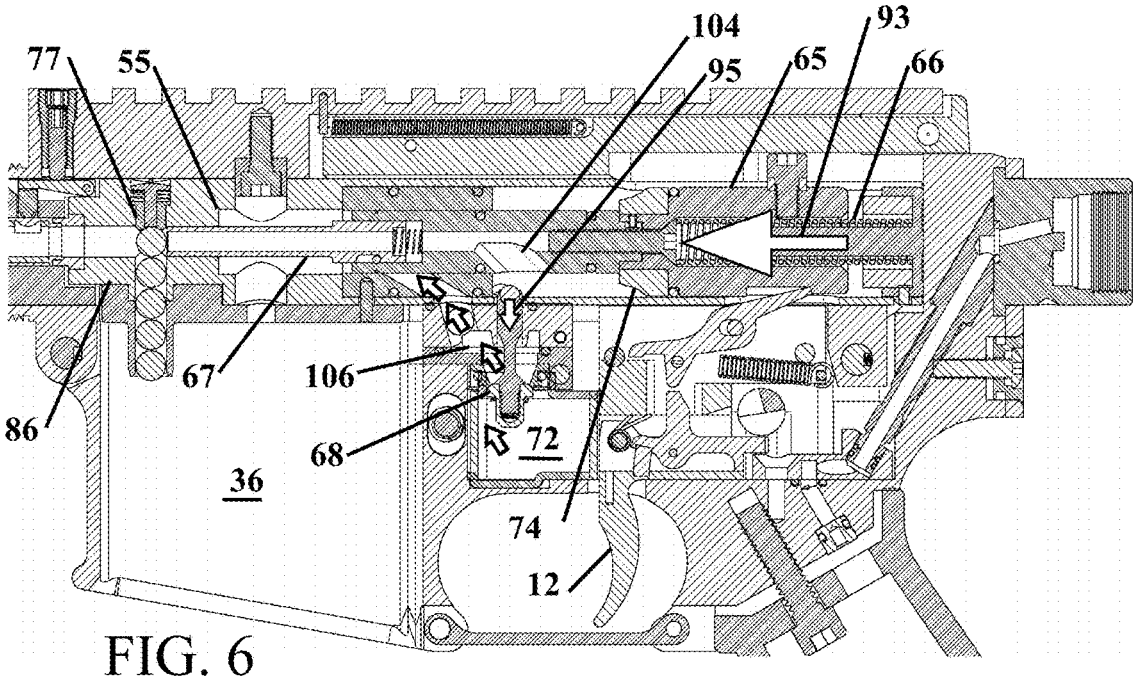
FIG. 6 shows a cross sectional view of the launcher with the hammer in the back position.

FIG. 6 shows a cross sectional view of the launcher with the hammer in the back position. The projectile locator 77 has been lifted as the forward bolt 77 moves forward to push the projectile into the breach 114. With the two-part bolt 67 and 65 in this position, pressure is maintained in space 72. When the trigger 12, spring 66 forces the rear bolt 65 forward. The rear bolt 65, along with the forward bolt 67, moves forward 93. The bolt(s) move forward 93 until the ramp 74 hits the top of the valve 68, the valve is pushed down 95 to release pressurized air from within the space 72 or cavity through aperture 106.

Figure 7:
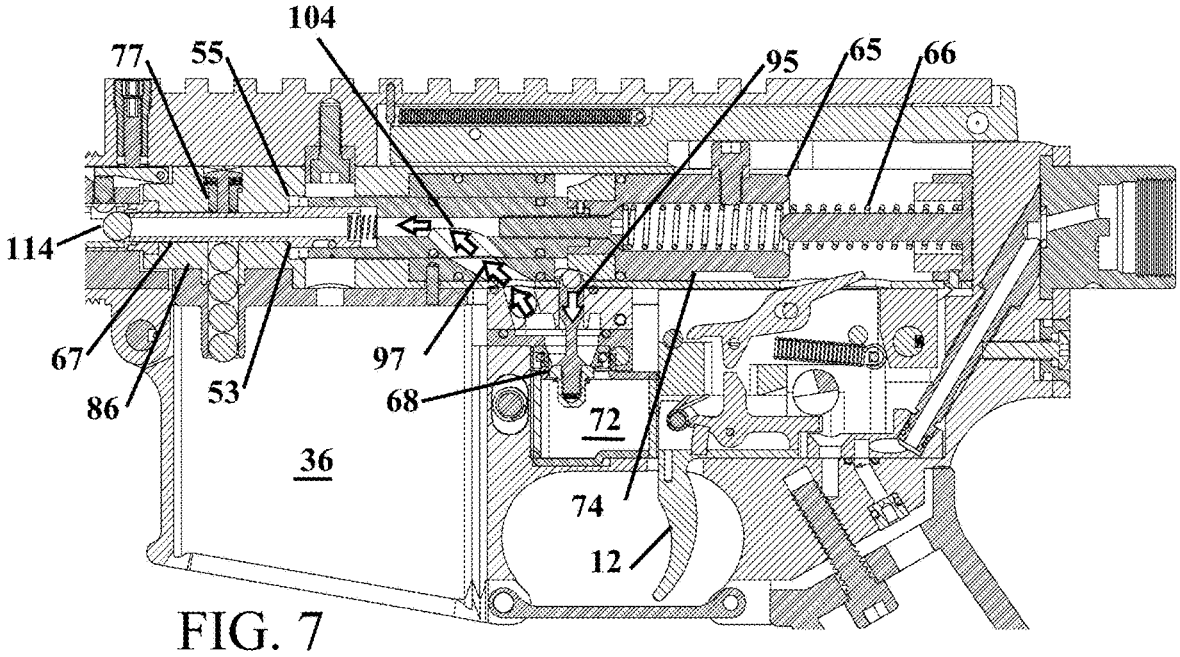
FIG. 7 shows a cross sectional view of the launcher as the two-part bolt begins to compress.

FIG. 7 shows a cross sectional view of the launcher as the two-part bolt 67/65 begins to compress just as the ramp 74 contacting the valve 68. The leading shoulder 53 of the forward bolt 67 has made contact with the end of the inside diameter 55 of the bolt sleeve 86. The arrows show a firing air path channel 97, but because the valve 68 is down 95, pressurized air in the space 72 can't pass the valve 68. As the forward bolt 67 is pushed forward the projectile 114 is moved just behind the adjustable nugget or barrel detent 48 of the elastomeric controller "hoppa system". The "hoppa system" barrel detent 48 is adjustable 49 to alter the pressure on the top of the projectile in the breach 114 when it is launched to create backspin 91 on the projectile 15 as it leaves the breach. From this figure, the launch has not fired because the ball has not struck by pressurized air from within the pressurized space 72 because the valve 68 because the top of the valve 68 has not been struck to go down 95. The rear bolt 65 still has some forward movement as it overcomes the spring 73 (as previously shown and described).

Figure 8:
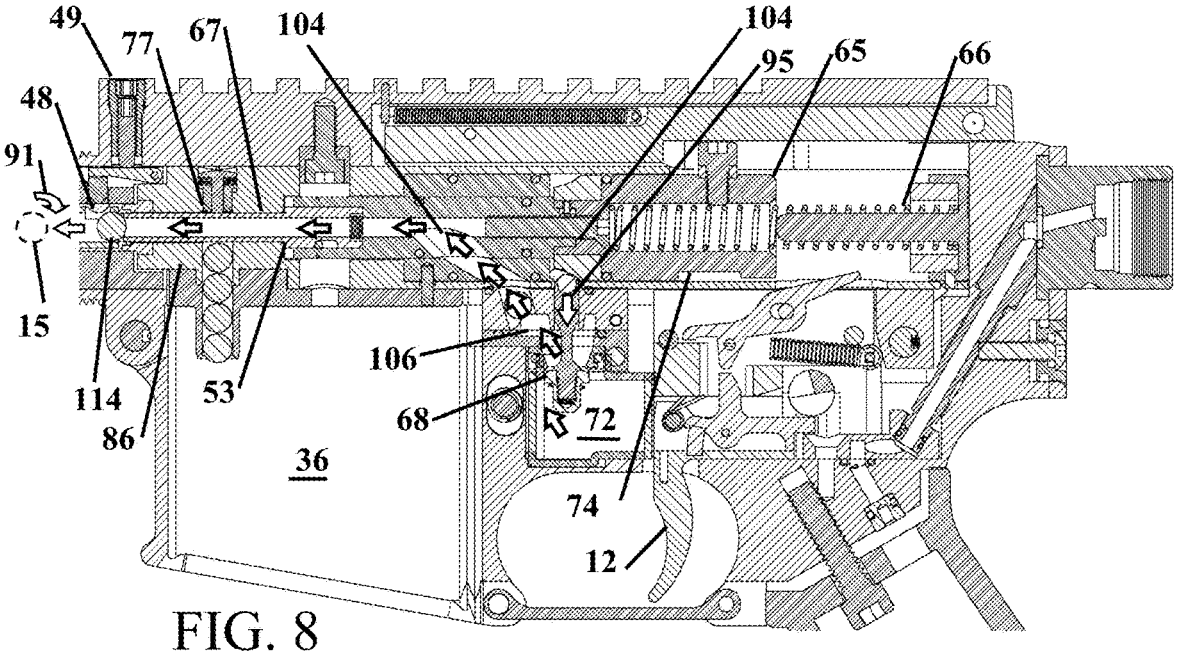
FIG. 8 shows a cross sectional view of the launcher with the two-part bolt in full compression.

FIG. 8 shows a cross sectional view of the launcher with the two-part bolt 67/65 in full compression so valve 68 is opened to provide a contiguous channel from the pressurized space 72 through valve 68, through the firing air path 97, through the bolt sleeve aperture 104 and through the hollow center of the two-part bolt 67/65. The pressurized air will then push against the projectile until the air pressure pushes the projectile past the barrel detent 48. The barrel detent 48 is only located at the top of the barrel to impart a backspin 91 on the projectile 15 to maintain a straight flight to overcome some (or all) of the forces of gravity for at least some of the flight time of the projectile.

When high pressure pushes the back of the projectile in the breach 114 no portion of the bolt acts like a piston to drive air or a component backwards, that might result in a "spongy shot" where all of the air is not directed to the ball to go forward, but by the surface area acting on the projectile 15 that might cause some componentry to go backwards unless we have incorporate the piston area 43 that maintains more pressure behind this piece the forward bolt 67, to keep the forward bolt 67 from being urged rearward because there is spring 73 pressure against second side of the forward bolt 67.

The spring 73 pressure exceeds any pressure that can build-up behind the projectile that could cause the forward bolt 67 to go backward regardless of the weight or mass of the projectile 15 or if the projectile 15 is larger. In this embodiment the projectile is 6 mm or 0.236 inches in diameter. If the projectile is a different diameter the components of the launcher would be re-proportioned. The portion is at least a 30% greater cross-sectional area than the projectile. Projectiles of greater than 30 caliber or 0.300 diameter are contemplated. The Cross-sectional ratio of the piston to the projectile is preferably between 125% and 300%.

Figure 9A:
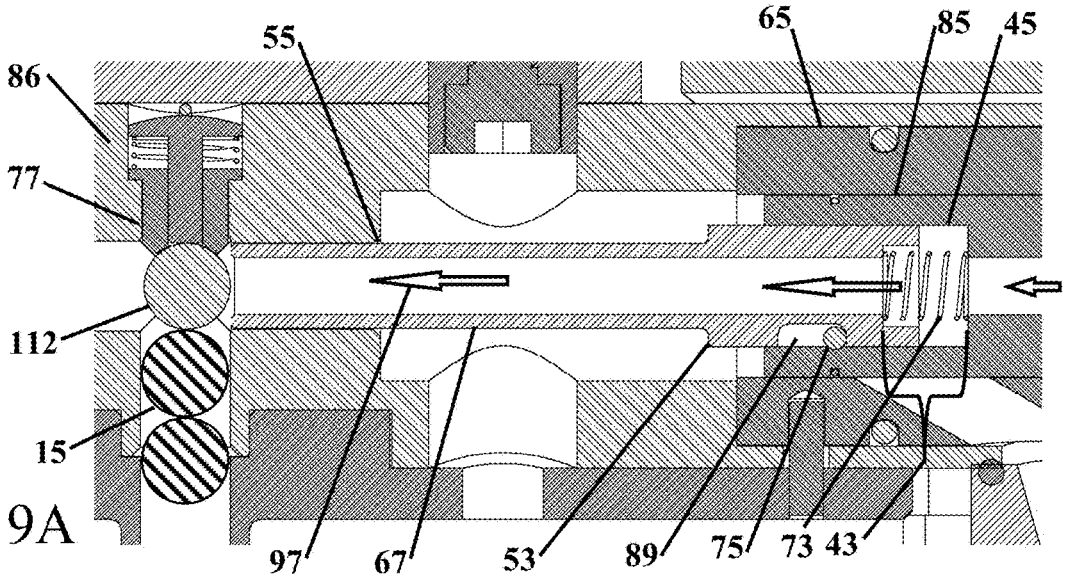
FIG. 9A-9C shows a detailed views of the bolt in movement.
Figure 9B:
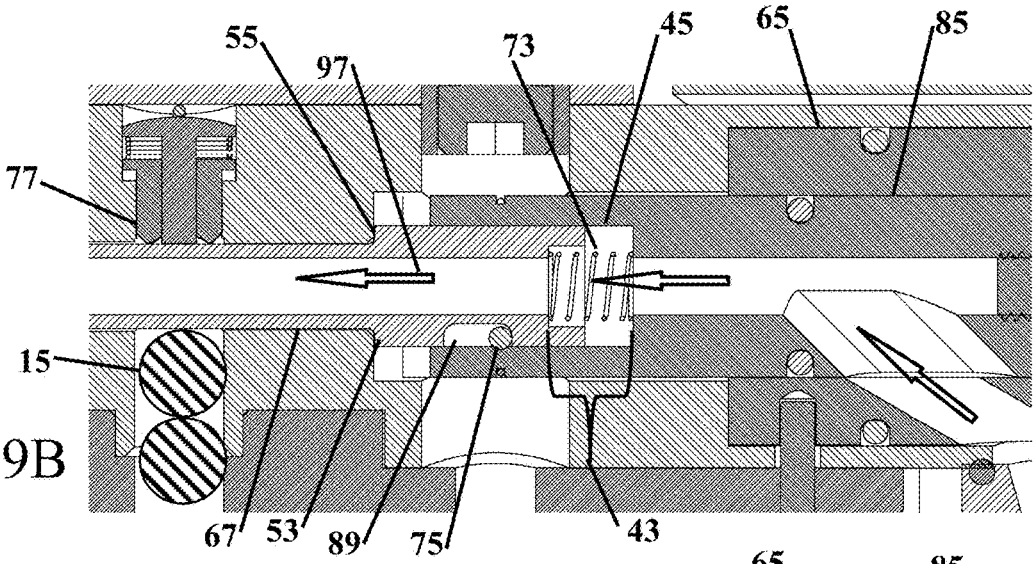
Figure 9C:
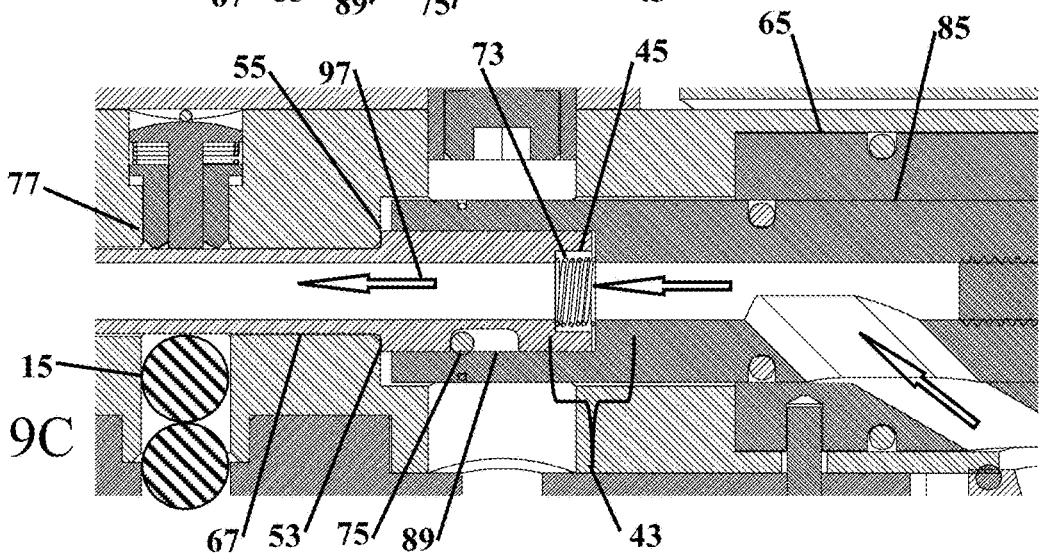

FIG. 9A-9C shows a detailed views of the two-part bolt in movement in the launcher. A first end (left in this view) of the forward bolt 67 moves the projectile, while the second end (right in this view) of the forward bolt 67. The second end of the forward bolt 67 fits into a recess 41 in a front end of the rear bolt 65. This creates a piston area 43 that is spring 73 loaded. The forward bolt 67 is retained in the rear bolt 65 with a pin 75 that is retained in the rear bolt 65 with a pin keeper spring 85. The travel of the forward bolt 67 is restrained by the pin 75 in a pin slot 89. Air can pass through the firing air path 97. In the preferred embodiment, the cross-sectional surface area of the spring recess 45, in the rear bolt 63, is twice the cross-sectional area of the projectile 15. While a cross-sectional ratio of twice is indicated, the ratio can be between 125% and 300%.

After the projectile is launched, the two-part bolt 67/83 is returned to the original position (as shown in FIG. 6) and a new projectile 15 is loaded/located in the projectile locator 77.

Thus, specific embodiments of a projectile launcher with a two-part bolt have been disclosed. It should be apparent, however, to those skilled in the art that many more modifications besides those described are possible without departing from the inventive concepts herein. The inventive subject matter, therefore, is not to be restricted except in the spirit of the appended claims.

The invention claimed is:

1. A projectile launcher with a two-part bolt comprising:
a forward bolt and a rear bolt;
said forward bolt having a first end that moves a projectile and a second end that is configured to fit within a recess of said rear bolt;
said forward bolt is biased in an extended position from a first end of said rear bolt with a spring;
said forward bolt and a rear bolt having an inside diameter that is configured for air to pass therethrough;
a pin that limits movement of said forward bolt in said rear bolt, wherein said pin is retained in a slot in said forward bolt, and
said pin is retained by pin keeper spring that extends at least partially around said rear bolt.

2. The projectile launcher with a two-part bolt according to claim 1, wherein said spring is a compression spring.

3. The projectile launcher with a two-part bolt according to claim 1, wherein said second end of said forward bolt forms a piston in a recess of said first end of said rear bolt.

4. The projectile launcher with a two-part bolt according to claim 3, wherein said spring is located in said piston.

5. The projectile launcher with a two-part bolt according to claim 3, wherein a cross-sectional ratio of said piston to a cross-sectional area of said first end of said forward bolt is between 125% and 300%.

6. The projectile launcher with a two-part bolt according to claim 5, wherein a cross-sectional ratio of said piston to a cross-sectional area of said first end of said forward bolt is between 200% and 250%.

7. The projectile launcher with a two-part bolt according to claim 1, wherein said forward bolt has a shoulder area located between said first end and said second end.

8. The projectile launcher with a two-part bolt according to claim 7, wherein said forward bolt is pushed into said rear bolt when said shoulder contacts an inside diameter of a bolt sleeve.

9. The projectile launcher with a two-part bolt according to claim 1, further includes a ball locator.

10. The projectile launcher with a two-part bolt according to claim 9, wherein said ball locator is at least partially extends into a bolt sleeve and is biased by a spring.

11. The projectile launcher with a two-part bolt according to claim 10, wherein said ball locator is configured to pushed out of said barrel as said first end of said forward bolt moves forward.

12. The projectile launcher with a two-part bolt according to claim 1, further includes a barrel detent.

13. The projectile launcher with a two-part bolt according to claim 12, wherein said barrel detent is adjustable.

14. The projectile launcher with a two-part bolt according to claim 12, wherein said barrel detent is an elastomeric material.

15. The projectile launcher with a two-part bolt according to claim 12, wherein said barrel detent is configured to impart a backspin on a projectile as said projectile passes under said barrel detent.

16. The projectile launcher with a two-part bolt according to claim 1, wherein said projectile is a BB or a paintball.

17. A projectile launcher with a two-part bolt comprising:
a forward bolt and a rear bolt;
said forward bolt having a first end that moves a projectile and a second end that is configured to fit within a recess of said rear bolt;
said forward bolt is biased in an extended position from a first end of said rear bolt with a spring;
said forward bolt and a rear bolt having an inside diameter that is configured for air to pass therethrough;
further includes a barrel detent, and
said barrel detent is configured to impart a backspin on a projectile as said projectile passes under said barrel detent.

18. The projectile launcher with a two-part bolt according to claim 17, wherein said barrel detent is adjustable.

19. The projectile launcher with a two-part bolt according to claim 17, wherein said barrel detent is an elastomeric material.

20. The projectile launcher with a two-part bolt according to claim 17, wherein said projectile is a BB or a paintball.

* * * * *